US008453756B2

(12) United States Patent
Andersson

(10) Patent No.: US 8,453,756 B2
(45) Date of Patent: Jun. 4, 2013

(54) ROCK DRILLING EQUIPMENT AND A METHOD IN ASSOCIATION WITH SAME

(75) Inventor: Kurt Andersson, Tyresö (SE)

(73) Assignee: Atlas Copco Rock Drills AB, Orebro (SE)

( * ) Notice: Subject to any disclaimer, the term of this patent is extended or adjusted under 35 U.S.C. 154(b) by 160 days.

(21) Appl. No.: 12/448,337

(22) PCT Filed: Jan. 10, 2008

(86) PCT No.: PCT/SE2008/000014

§ 371 (c)(1),
(2), (4) Date: Jun. 17, 2009

(87) PCT Pub. No.: WO2008/085114

PCT Pub. Date: Jul. 17, 2008

(65) Prior Publication Data

US 2010/0051348 A1 Mar. 4, 2010

(30) Foreign Application Priority Data

Jan. 11, 2007 (SE) ..... 0700063

(51) Int. Cl.
*B25D 9/12* (2006.01)

(52) U.S. Cl.
USPC ..... 173/128; 173/1; 173/135

(58) Field of Classification Search
USPC ..... 173/16–17, 210, 212; 175/135; 91/394, 91/404
See application file for complete search history.

(56) References Cited

U.S. PATENT DOCUMENTS

| | | | | |
|---|---|---|---|---|
| 4,429,751 | A | 2/1984 | Jackson et al. | |
| 4,593,768 | A * | 6/1986 | Eklof | 173/200 |
| 5,056,606 | A * | 10/1991 | Barthomeuf | 173/13 |
| 5,129,466 | A * | 7/1992 | Bartels et al. | 173/13 |
| 5,372,196 | A * | 12/1994 | Andersson | 175/296 |
| 5,479,996 | A * | 1/1996 | Jonsson et al. | 175/135 |
| 5,896,937 | A * | 4/1999 | Kaneko | 173/211 |
| 6,273,199 | B1 * | 8/2001 | Kiikka et al. | 173/1 |
| 6,371,222 | B1 * | 4/2002 | Andersson et al. | 175/135 |
| 6,510,902 | B1 * | 1/2003 | Prokop et al. | 173/1 |
| 6,557,652 | B2 * | 5/2003 | Klemm | 175/296 |

FOREIGN PATENT DOCUMENTS

| | | | |
|---|---|---|---|
| DE | 10237407 | A1 | 4/2004 |
| EP | 1 291 487 | A1 | 3/2003 |
| JP | 05337845 | A | 12/1993 |
| WO | WO 01/83170 | A1 | 11/2001 |

* cited by examiner

*Primary Examiner* — M. Alexandra Elve
*Assistant Examiner* — Andrew M Tecco
(74) *Attorney, Agent, or Firm* — Mark P. Stone

(57) ABSTRACT

A rock drilling machine with a first control means (21, 22) within a second piston (6) and acting on a first piston (13) such that it counteracts displacement of the relative positions of a first and a second control device at the moment of contact of the second piston onto the drill rod or onto a part (9) connected to this. Furthermore, a rock drill rig comprising such a rock drilling machine and a method for counteracting the said displacement. Significant improvements in reproducibility for impact mechanism stability over long manufacturing series are achieved through the invention. In the same way, the lifetime of rock drilling devices manufactured according to the invention is extended through the impact mechanism acting in a more stable manner despite wear of component parts. It is furthermore possible to dimension for higher rates of impact without risking the impact mechanism stability.

12 Claims, 3 Drawing Sheets

ROCK DRILLING EQUIPMENT AND A METHOD IN ASSOCIATION WITH SAME

TECHNICAL FIELD

The present invention concerns a rock drilling machine that has a control device in order to control, while in use, a change over in the pressure of a fluid acting on a piston that repeatedly impacts upon a drill rod connected to the drilling machine. It refers also to a drill rig with such a machine mounted and a method intended to be in use within such a drilling machine.

BACKGROUND

Rock drilling devices of the type described here, intended for drilling in rock, are fluid driven, most often hydraulically. An example of a rock drilling device according to such prior art technology is illustrated schematically in FIG. 1. The drilling device 1 can be connected to a fluid container, such as a tank 2 of hydraulic liquid. A pump 3 is used to create a source of hydraulic liquid under high pressure. A slide valve 4 controls, in interaction with control devices in a piston housing 7 and on the hammer piston 6, the hydraulic liquid such that at least one driving surface 5 of the hammer piston that runs in a piston housing in the drilling device is subject alternately to high pressure and to low pressure.

The hammer piston 6 is arranged such that it impacts at its forward end, the piston tip 8, onto the shank 10 of a drill adapter 9. A drill rod can be connected to the drill adapter 9 for the intended drilling into a surface to be drilled, such as into rock. Several drill rods can be connected together to form a drill string of such a length that the desired depth of drilling can be achieved. A control conduit 11*a* is present in the piston housing 7, which control conduit is arranged in connection with the source 3 of hydraulic liquid. This control conduit 11*a* interacts with a control chamber 12 formed between the hammer piston 6 and the piston housing 7, whereby the slide 4 can be controlled depending on the position of the hammer piston 6 in the axial direction relative to the piston housing 7. A conduit 11*b* exerts constant pressure onto a control edge of the hammer piston 6 for driving the piston backwards.

In order to maintain the drill rod in constant contact with the surface to be drilled and in order to maintain the parts of the drill string in constant contact with each other, a recoil damper, with a recoil piston 13 included, is arranged. This recoil piston 13 is normally arranged concentrically around the front part of the hammer piston 6. The recoil piston 13 is held pressed against the shank 10 of the drill adapter 9 by means of hydraulic liquid from a pressure conduit 14 that is arranged in contact with a high-pressure source through a constant-flow valve, such that the hammer piston 6 can impact against a non-elastic surface when it impacts onto the shank of the drill adapter.

The complete drilling device is pressed during drilling against the object to be drilled with a feed force. The feed force can be applied, for example, hydraulically in a drill rig, which is an equipment for setting the position and angle of one or several drilling devices while drilling. The drilling device is then often mounted on a carriage that can be displaced along a feed beam in the drill rig. If the feed force becomes greater than the recoil pressure, i.e. the product of the pressure in the liquid that drives the damper piston forward in the direction of drilling and the cross-sectional area of the recoil piston, or—to be more accurate—the driving surface of the recoil piston on which the liquid acts, then the recoil piston will be pressed backwards. In order to counteract this and to achieve as far as possible constant conditions when the hammer piston impacts onto the drilling steel or the shank adapter, a drainage conduit or balance conduit 16 has been arranged, which functions as described below.

Instead of the recoil piston 13 making direct contact with the shank 10 of the drill adapter 9, a bushing 15 can be placed in the damper between the recoil piston 13 and the shank 10 of the drill adapter 9, as is shown in, for example, the document U.S. Pat. No. 5,479,996. The recoil piston 13 has an additional function, which is that of absorbing recoil forces from the surface to be drilled when the drill steel is pressed against this surface with the impact force that is transmitted from the hammer piston 6. The recoil piston 13 absorbs the pressure that is transmitted back from the surface to be drilled hydraulically, and thus it oscillates in the axial direction controlled by the pressures to which is subject from hydraulic liquid and from the recoil forces from the drill steel. The recoil piston 13 is for this reason provided with a drive chamber 14*b* formed between the recoil piston and the piston housing. This drive chamber is limited by at least one forward driving surface 13*b* in the recoil piston. The drive chamber 14*b* is drained through a balance conduit 16 in the piston housing 7 when the recoil piston reaches a position that is sufficiently far forward. If the recoil piston 13 is driven backwards, such that the driving surface 13*b* becomes located behind the balance conduit 16, then the pressure in the drive chamber 14*b* will rise, whereby the pressure on the driving surface 13*b* entails the recoil piston 13 being driven forwards. If, on the other hand, the recoil piston 13 is driven forwards such that the driving surface 13*b* frees the opening of the balance conduit 16 with respect to the drive chamber 14*b*, then the drive chamber will be drained through the balance conduit 16, whereby the pressure in the drive chamber will 14*b* fall, which in turn entails the piston being pressed backwards. The recoil piston will in this way take up a position that balances around the point at which the driving surface 13*b* of the recoil piston opens the drive chamber 14*b* for the balance conduit 16.

One problem with the technology described above is that the function of the impact mechanism tends to be unstable in some devices, particularly when dimensioning for high rates of impact, and particularly after a certain period of operation.

OBJECT OF THE INVENTION AND ITS PRINCIPAL CHARACTERISTICS

One object of the present invention is to achieve a method to reduce the above-mentioned problems with the prior art technology.

It has been shown that significant improvements in the repeatability of impact mechanism stability for long manufacturing series of rock drilling devices can be achieved with the invention. In the same way, the lifetime of rock drilling devices manufactured according to the invention is extended through the impact mechanism acting in a more stable manner despite wear of component parts. It is furthermore possible to dimension for higher rates of impact without risking the impact mechanism stability.

According to the invention, instead of, as has been done up until now, allowing the drive chamber 14*b* of the recoil piston 13 to be drained when the recoil piston has reached a predetermined position relative to the piston housing, this drainage will take place when the hammer piston 6 is located at a pre-determined position relative to the piston housing. Since the control devices for the forwards/backwards change-over of the percussion arrangement are located on the hammer piston and in the piston housing, respectively, the relative position of these control devices will come under better control in the instant at which the hammer piston impacts on the drilling shank. In particular, the relative position at this instant will become independent of a number of manufacturing tolerances. In the same way, sensitivity to wear of component parts, such as the piston tip, the shank and the recoil piston, will be reduced. An improved impact mechanism stability with time, for long manufacturing series and at increasing rates of impact is achieved in this manner.

DETAILED DESCRIPTION OF PREFERRED EMBODIMENTS

A number of embodiments of the invention will be described below, supported by the attached drawings, in order to provide examples. The invention is not limited to the embodiments described: it is determined by the scope defined by the claims.

Figure 1:
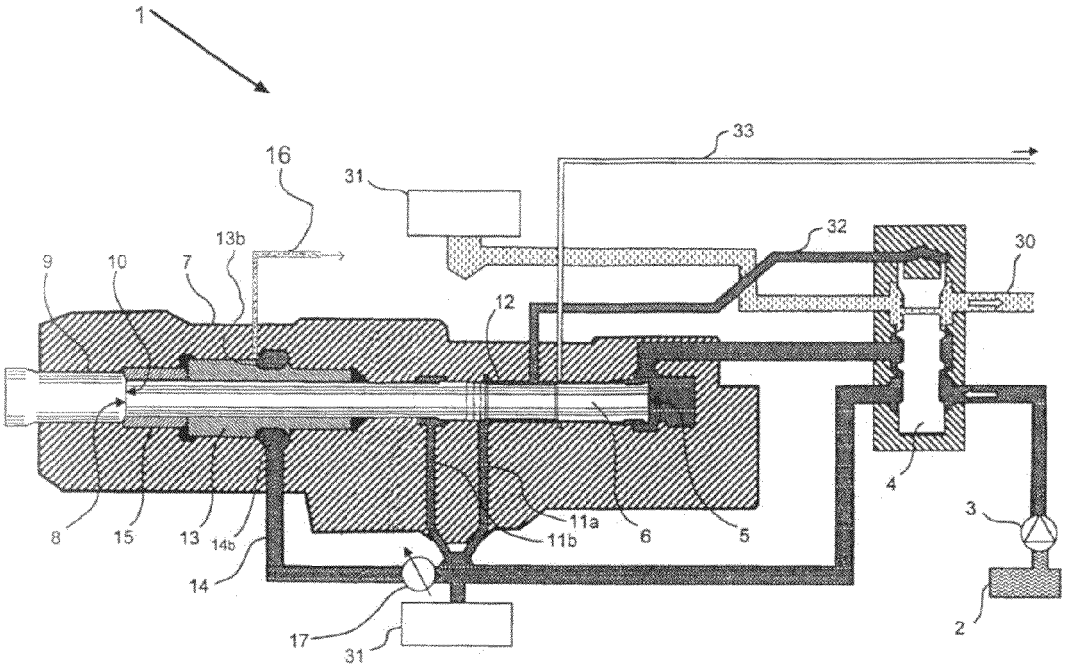
Fig. 1 Prior art
FIG. 1 shows schematically a longitudinal cross-section through a hydraulic rock drilling device according to the prior art technology.
Figure 2:
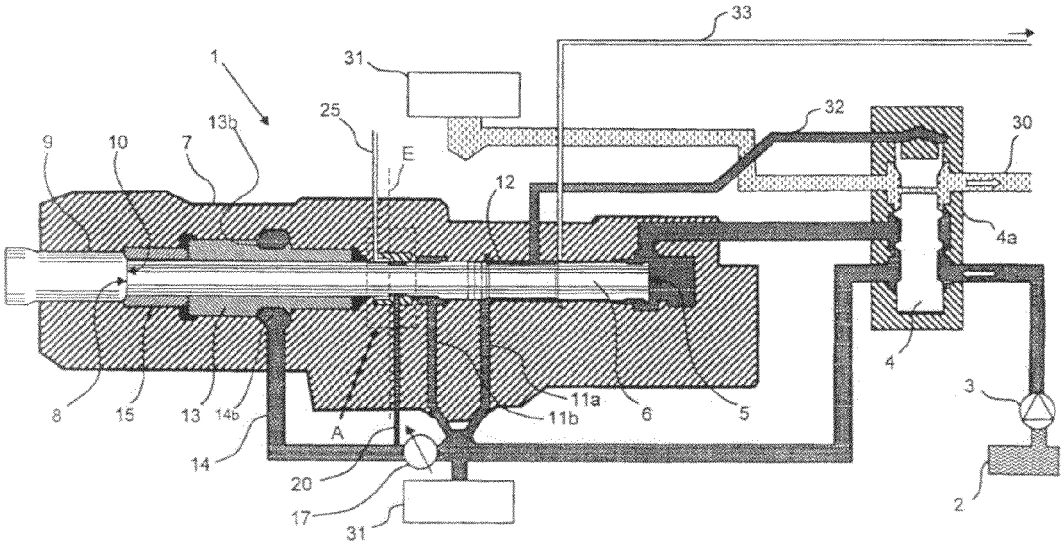
FIG. 2 shows schematically a corresponding longitudinal cross-section through a hydraulic rock drilling device according to the invention.

FIG. 2 shows an example of a hydraulic rock drilling device 1 according to one aspect of the invention. The drilling device 1 can be connected to a fluid container, such as a tank 2 of hydraulic liquid. A pump 3 is used to create a source of hydraulic liquid under high pressure. Furthermore, a second piston 6, known as the "hammer piston", is part of the device, running in the axial direction in a piston housing 7, which constitutes at the same time the device housing of the drilling device. A slide 4, located in a slide housing 4*a*, in interaction with control devices (12, 11*a*, 33, 32), controls a hydraulic liquid such that at least one driving surface 5 of the second piston 6 is subject to a change-over of the pressure, i.e. alternation between high and low pressure.

The second piston 6 is according to the prior art technology arranged such that, when in use, it provides repetitive impacts at its forward end, the piston tip 8, onto the shank 10 of a drill adapter 9. The drill adapter 9 is mounted in bearings in the piston housing 7 and it is aligned with the second piston 6. Thus the drill adapter 9 and the second piston 6 lie along the same axis. A drill rod can be connected to the drill adapter 9, or a drill string having several connected drill rods, for the intended drilling into a surface to be drilled, such as into rock. First control device, in the form of a control conduit 11*a*, a slide signal line 32 and a drainage conduit 33, are present in the piston housing 7. The control conduit 11*a* is in contact with the source 3 of hydraulic liquid. A second control device is constituted by a control chamber 12 formed between the second piston 6 and the piston housing 7, preferably in the form of an annular groove in the piston 6. The slide 4 can be controlled in dependence of the position in the axial direction of the second piston 6 relative to the piston housing 7, by influence of the pressure in the slide signal line 32.

Figure 3:
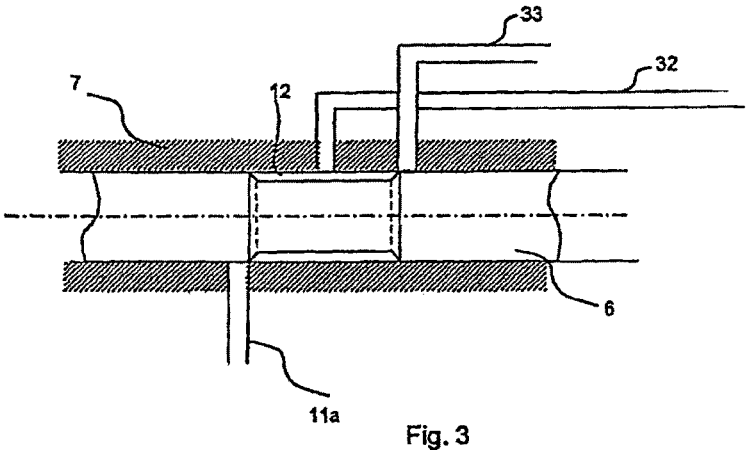
FIG. 3 shows schematically a partial enlargement of control devices that ensure the change over of the pressure required to achieve the repetitive impacts by means of the hammer piston according to the prior art technology.

The control of the change-over of the pressure will be illustrated with reference to FIG. 3. It can be seen in this drawing that when the second piston 6 moves to the right, the pressure in the control chamber 12 will rise to the pressure at the level of pressure of the hydraulic liquid from the source 3. An outlet is hereby opened from the control chamber 12 to the drainage line 33, whereby the pressure in the control chamber falls to the drainage level. The change in the pressure in the control chamber 12 is transmitted through the slide signal line 32 and influences the slide 4, such that hydraulic liquid at high pressure influences the second piston through the driving surface 5 such that the second piston moves to the left in the drawing. The drainage line 33 will in this way be closed, while the control conduit 11*a* opens onto the control chamber 12 and it increases once again the pressure in this chamber. This in turn entails the pressure on the driving surface 5 at the end of the second piston 6 being removed through the action of the slide 4. The method is subsequently repeated according to the pattern described.

In order to maintain the drill steel in constant contact with the surface to be drilled and in order to maintain the parts of the drill string in constant contact under pressure with each other, a recoil damper is present including a recoil piston, a first piston, 13. This recoil piston 13 is normally arranged concentrically around the forward part of the second piston 6 (where the term "forward" in this description is used to denote the direction of drilling). The recoil piston 13 is held pressed against the shank 10 of the drill adapter 9 by means of hydraulic liquid from a pressure conduit 14 that is placed in contact with a high-pressure source 3 through a constant-flow valve 17, such that the second piston 6 can impact against a non-elastic surface when it impacts the shank 10 of the drill adapter 9.

Figure 4:
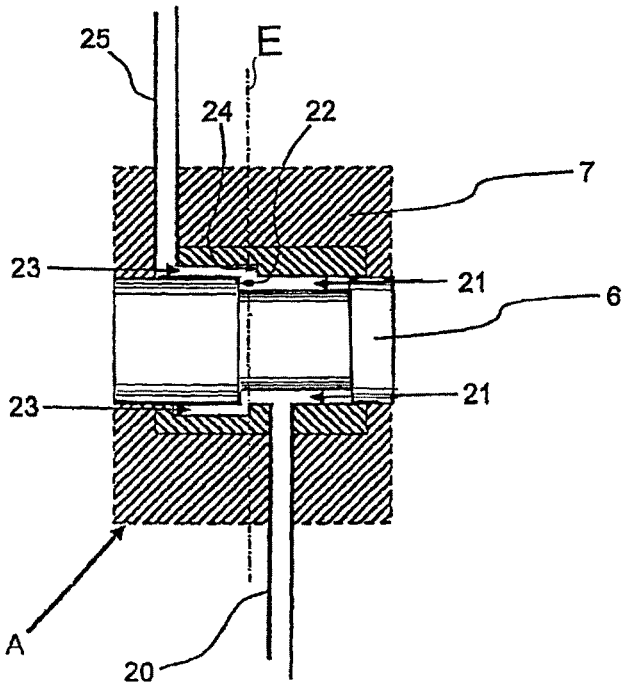
FIG. 4 shows schematically an enlargement of the region A of FIG. 2 and illustrates more clearly the function of control means according to an embodiment of the inventive concept.

Instead of the recoil piston 13 making direct contact with the shank 10 of the drill adapter 9, a bushing 15 can be placed in the damper between the recoil piston 13 and the shank 10 of the drill adapter 9. The recoil piston 13 has, as has been mentioned, an additional function, which is that of absorbing recoil forces from the surface to be drilled when the drill bit is pressed against this surface with the impact force that is transmitted from the second piston 6. The recoil piston 13 absorbs hydraulically the force that is transmitted back from the surface to be drilled, and thus it oscillates in the axial direction controlled by the pressures to which it is subject from hydraulic liquid and from recoil forces from the drill steel. The recoil piston 13 is for this reason provided with a drive chamber 14*b* formed between the recoil piston 13 and the piston housing 7. The drive chamber is limited by at least one forward driving surface 13*b* in the recoil piston. The drive chamber 14*b* is drained when the hammer piston 6 reaches a position sufficiently far forwards in the piston housing 7 through a first control means 21, 22 located in a second piston 6 (the hammer piston) and a second control means 20, 23, 24, 25 located in the piston housing 7. The function is made clear in more detail in FIG. 4, which is a partial enlargement of A in FIG. 2.

The second control means includes an adjustment conduit 20 that is in connection with the pressure conduit 14 that is connected to the drive chamber 14*b* of the recoil piston and that opens out into the cylinder bore in the piston housing. When the hammer piston 6 approaches the pre-determined location for the impact onto the shank 10, a first compartment 21 that is formed between the hammer piston and the piston housing and that belongs to the first control means will receive oil from the adjustment conduit 20. If the hammer piston reaches a position sufficiently far forwards that a first control edge 22 in the first control means passes a second control edge 24 that belongs to the second control means, then the oil from the drive chamber 14*b* will be drained onwards through a second compartment 23 formed between the hammer piston and the piston housing and belonging to the second control means, and subsequently through the drainage line 25. The recoil pressure will in this way be reduced and the feed force will drive the shank backwards until the drainage process ceases, the pressure in the drive chamber 14*b* again rises, and the drilling shank 10 is in this way driven again forwards. The shank 10 is thus balanced around a position E that is directly coupled with the actual position of the hammer piston.

Furthermore, a return conduit 30 for hydraulic liquid is shown in the drawings, which return conduit returns hydraulic liquid to the tank 2 through the slide 4. Gas accumulators 31 are located not only in the pressure conduit 14 but also in the return conduit 30 in order to even out pressure differences in the lines. It must also be emphasised here that the conduits for achieving the complete control are not fully illustrated in the drawings: they are illustrated only schematically, since this constitutes prior art technology and does not affect the invention.

The location of the position E is selected such that the desired length of travel is achieved. The second piston 6 is to move along a certain distance from its impact position before a point is passed at which the travel of the slide is reversed. When this occurs, the slide 4 starts to move and the pressure on the driving surface 5 of the second piston changes from low pressure to high pressure, i.e. the motion of the second piston 6 changes from a return motion to become an impact motion.

Also other solutions for the drainage of the drive chamber 14*b* of the recoil piston are possible within the scope of the invention. Thus, the position of the hammer piston can be determined using electronic sensors that identify a position that corresponds to the position E, and a magnetic valve is subsequently operated in order to drain the drive chamber 14*b*. The sensors can be, for example, of inductive type or of capacitive type. Also electromagnetic radiation, such as light, for example, may be used for detection. It is in this case suitable that the sensor corresponds to the second control means and it can be mounted against the piston housing in order to measure either in the radial direction or in the axial direction. The first control means can be constituted by a groove formed in the hammer piston, an insert that possesses, for example, different magnetic properties, a pattern of stripes, etc. The first control means can, in its simplest form, be constituted by the rear edge or the end surface of the piston.

The forward and reverse motion of the hammer piston can be generated by energy stores, such as energy stored in volumes of oil, that replace the slide valve, instead of being generated by the interaction of the control devices with the slide, as has been described here. This constitutes prior art technology and such devices, known as "slideless" or "valveless" devices are commercially available.

Figure 5:
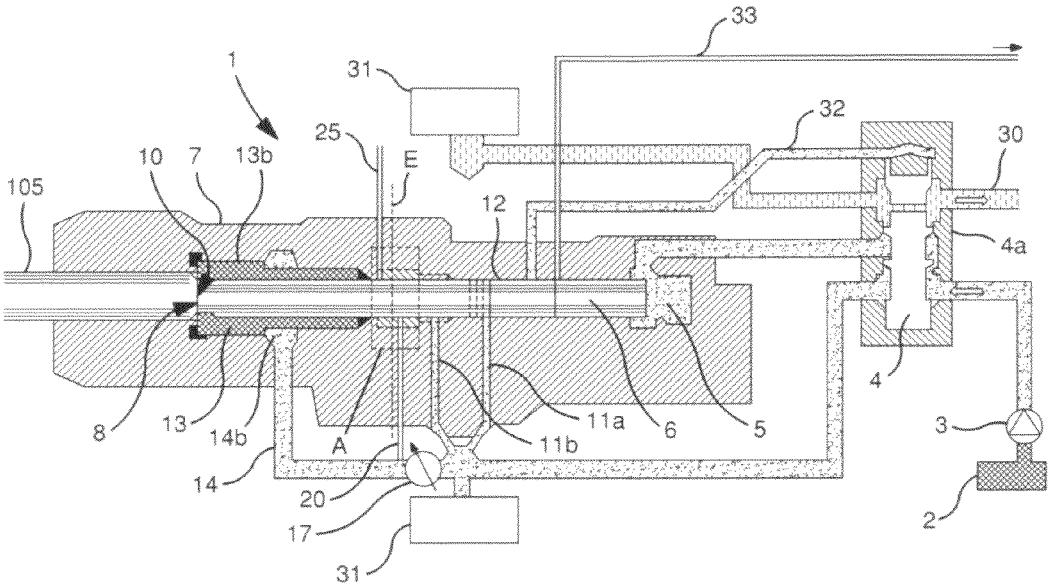
FIG. 5 is similar to FIG. 2, but illustrates direct contact between the first piston and drill steel.

FIG. 5 of the drawing is similar to FIG. 2, except that a drill steel 105 is illustrated in place of the adapter 9 in FIG. 2 to show direct contact between the first piston 13 and the drill steel, and contact of the second piston 6 onto the drill steel 105.

Figure 6:
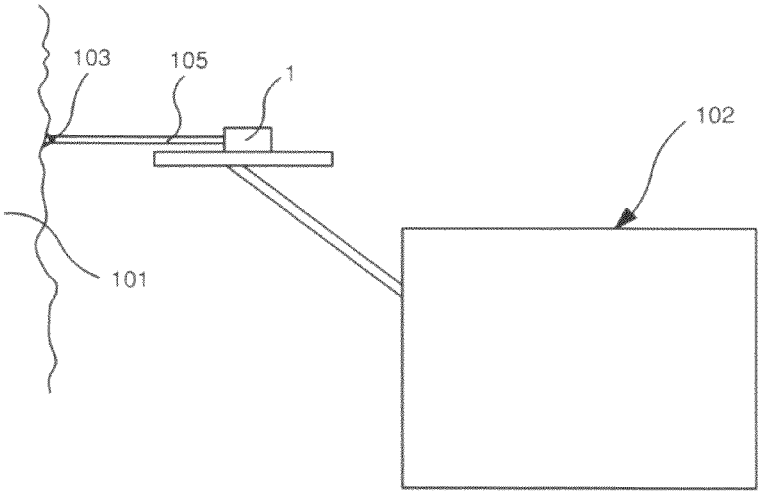
FIG. 6 schematically illustrates a drill rig having a rock drilling device, a drill steel and a drill bit impacting a rock.

FIG. 6 schematically illustrates a conventional drill rig 102 with a rock drilling device 1, a drill steel 105, and a drill bit 103 impacting a rock designated by reference numeral 101.

The invention claimed is:

1. A rock drilling device including:

a piston housing, a first piston movably mounted in the said piston housing and adapted such that it transfers force while in use, principally continuously, directly or indirectly, in the direction of drilling to a drill steel connected to the rock drilling device, said first piston adapted to receive pressure from a fluid acting thereon to maintain said first piston In contact, directly or indirectly, with said drill steel, a second piston adapted such that it imposes impacts repetitively while in use, either directly or indirectly, onto the connected drill steel, a first changeover control device within or mounted on the piston housing arranged to control, in collaboration with a second changeover control device within the second piston, a change-over of the pressure of a fluid acting on the said second piston, wherein said rock drilling machine includes first displacement control means within said second piston acting on said first piston to counteract displacement of said first and second changeover control devices relative to each other by reducing said fluid pressure acting on said first piston at a predetermined relative position of said first and second changeover control devices, said predetermined relative position corresponding to the relative position of said second piston relative to said piston housing at the instant of initial contact of the second piston onto the drill steel or onto a part connected to the drill steel.

2. The rock drilling device according to claim 1, wherein said rock drilling machine includes second displacement control means in or mounted to the piston housing which, in cooperation with said first displacement control means, drains the fluid acting on said first piston when said first and second changeover control devices are in said predetermined relative position.

3. A rock drill rig comprising at least one rock drill device according to claim 2.

4. The rock drilling device according to claim 1, wherein the first piston is adapted such that it converts, during operation of the rock drilling device, pressure in a portion of fluid to a force that acts, principally continuously, in the direction of drilling, either directly or indirectly, on a drill steel connected to the rock drilling device or on a part connected to the drill steel, and wherein said first displacement control means is arranged to reduce the pressure in the portion of the fluid when the second piston is located in a more advanced position, in the direction towards the drill steel, then said predetermined relative position of the first and second changeover control devices.

5. A rock drill rig comprising at least one rock drill device according to claim 4.

6. A rock drill rig comprising at least one rock drill device according to claim 1.

7. The rock drilling device according to claim 1, wherein said first piston is pressed against said drill steel or said part connected to said drill steel before said second piston impacts against said drill steel or said part connected to said drill steel.

8. The rock drilling machine according to claim 1, wherein said first changeover control device within or mounted to said piston housing comprises a supply conduit in fluid communication with a first chamber defined between a portion of said second piston and said piston housing, and a discharge conduit in fluid communication with a second chamber defined between a wider portion of said second piston and said piston housing.

9. The rock drilling device according to claim 8, wherein said second changeover control device within said second piston comprises a leading edge on said wider portion of said second piston movable relative to a control edge of said piston housing for controlling the flow of fluid through said supply and discharge conduits.

10. A method for a rock drilling device comprising:

a piston housing, a first piston movably mounted in said piston housing and adapted such that it, during operation of the rock drilling device, converts pressure in a portion of a fluid into a force that acts, principally continuously, in the direction of drilling, either directly or indirectly, on a drill steel connected to the rock drilling device, a second piston adapted such that it repetitively imposes impacts in the direction of drilling while in use, either directly or indirectly, on the said drill steel connected to the rock drilling device, a first changeover control device within or mounted on the piston housing and a second changeover control device within the said second piston, wherein said first and second changeover control devices are caused to control, while in interaction with each other, a change-over of the pressure of a fluid that acts on a driving surface on said second piston to achieve the said repetitive impacts, wherein the steps of said method include providing at least first displacement control means, and arranging said first and second changeover control devices relative to each other for reducing the pressure of the fluid acting on said first piston in a direction towards said drill steel by said first displacement control means at a predetermined relative position of said first and second changeover control devices, said predetermined relative position corresponding to the relative position of the second piston relative to the piston housing at the instant of initial contact of the second piston onto the drill steel or a part connected to the drill steel.

11. The method according to claim 10, wherein the pressure in the fluid applied to the first piston is reduced by draining the fluid acting on said first piston when said first and second changeover control devices are in said predetermined relative position.

12. The method according to claim 10, including the step of pressing said first piston against said drill steel or said part connected to said drill steel before said second piston impacts against said drill steel or said part connected to said drill steel.

* * * * *

UNITED STATES PATENT AND TRADEMARK OFFICE

CERTIFICATE OF CORRECTION

PATENT NO. : 8,453,756 B2
APPLICATION NO. : 12/448337
DATED : June 4, 2013
INVENTOR(S) : Kurt Andersson It is certified that error appears in the above-identified patent and that said Letters Patent is hereby corrected as shown below:

In the Claims

Claim 1, Line 9 (Column 6, Line 10): Delete “In” and substitute --in--.

Claim 1, Line 19 (Column 6, Line 20): Delete “machine” and substitute --device--.

Claim 2, Line 2 (Column 6, Line 33): Delete “machine” and substitute --device--.

Claim 3, Line 1 (Column 6, Line 39): Delete “drill” and substitute --drilling--.

Claim 4, Line 10 (Column 6, Line 50): Delete “then” and substitute --than--.

Claim 5, Line 1 (Column 6, Line 53): Delete “drill” and substitute --drilling--.

Claim 6, Line 1 (Column 6, Line 55): Delete “drill” and substitute --drilling--.

Signed and Sealed this
Fifteenth Day of October, 2013

Teresa Stanek Rea
*Deputy Director of the United States Patent and Trademark Office*